United States Patent [19]

Power

[11] 3,983,695

[45] Oct. 5, 1976

[54] ION BEAM THRUSTER SHIELD

[75] Inventor: John L. Power, North Olmsted, Ohio

[73] Assignee: The United States of America as represented by the Administrator of the National Aeronautics and Space Administration, Washington, D.C.

[22] Filed: Sept. 12, 1975

[21] Appl. No.: 612,964

[52] U.S. Cl. ..... 60/202; 313/361; 313/231.4; 313/240; 315/111.3

[51] Int. Cl.[2] ..... F03H 1/00

[58] Field of Search ..... 60/202; 313/359, 361, 313/231.4–231.6, 239, 240; 315/111.3, 111.8, 111.9

[56] References Cited

UNITED STATES PATENTS

| | | | |
|---|---|---|---|
| 3,020,431 | 2/1962 | Martina | 60/202 |
| 3,130,542 | 4/1964 | Kuhrt | 60/202 |
| 3,232,046 | 2/1966 | Meyer | 60/202 |
| 3,392,527 | 7/1968 | Gilmour et al. | 60/202 |
| 3,537,266 | 11/1970 | Mahadevan et al. | 60/202 |
| 3,555,823 | 1/1971 | Guman | 60/202 |

*Primary Examiner*—Carlton R. Croyle
*Assistant Examiner*—Robert E. Garrett
*Attorney, Agent, or Firm*—N. T. Musial; G. E. Shook; John R. Manning

[57] ABSTRACT

An ion thruster beam shield is provided that comprises a cylindrical housing that extends downstream from the ion thruster and a plurality of annular vanes which are spaced along the length of the housing, and extend inwardly from the interior wall of the housing. The shield intercepts and stops all charge exchange and beam ions, neutral propellant, and sputter products formed due to the interaction of beam and shield emanating from the ion thruster outside of a fixed conical angle from the thruster axis. Further, the shield prevents the sputter products formed during the operation of the engine from escaping the interior volume of the shield.

13 Claims, 3 Drawing Figures

ION BEAM THRUSTER SHIELD

ORIGIN OF THE INVENTION

The invention described herein was made by an employee of the United States Government and may be manufactured and used by or for the Government of the United States without the payment of any royalties thereon or therefor.

FIELD OF THE INVENTION

This invention relates to ion thrusters and more particularly to a beam shield for physically defining the angular divergence of an ion beam produced by an ion thruster.

BACKGROUND OF THE INVENTION

Most conventional ion thrusters do not employ any type of shield for the thruster beam. It should be noted here that the ground screen which surrounds the thruster except for the grids is not considered to be a beam shield as the term is used herein. With no beam shield employed, the angular distribution of beam current density from, for example, a mercury ion thruster tends to exhibit a roughly exponential falloff with increasing angles of divergence from about 30° to about 80° and a relatively flat angular divergence from about 80° to as large as 120°. The flat distribution is known to consist nearly exclusively of low energy charge exchange-produced ions. Accompanying the ion flux at all divergence angles, and perhaps outweighing it at the larger angles, is a flux of sputter products and other neutral species. Hence, in ion thruster applications for spacecraft, any spacecraft structure or component in at least the forward hemisphere about the thruster axis is subjected to a flux of ions and neutral molecules, of various energies and elemental composition, whenever the ion thruster is operated.

Many spacecraft structures, components, and instruments are particularly sensitive to, and may be very readily damaged by, such a flux of ions and neutral molecules, particularly when continued over a substantial period of time. Further, exposed electrical insulators may collect enough neutral species and sputter products to develop excessive electrical leakage or even short out. The surface layers or surface protection of exposed solar cells may be sputter eroded by energetic beam ions to such a degree, or coated by the neutral species and sputter products to such an extent, that the solar cells lose significant power generating efficiency. Exposed optical windows of sensitive optical devices, such as star trackers, also may either be coated or sputter eroded sufficiently to affect the performance of the devices. The same may also occur to exposed thermal control surfaces of the spacecraft. Also the ion (and electron) flux, which is actually a dilute plasma, may be sufficiently intense in the region or view of sensitive electromagnetic devices, instruments, or detectors mounted near the ion thruster to directly interfere with their operation.

Prior art ion thruster spacecraft designs have generally sought to overcome the above problems by locating and directing the ion thrusters relative to the structures, components, and instruments of the spececraft most sensitive to the divergent thruster beam so that the interaction is minimized or reduced to tolerable levels. However, since objectionable interaction may occur within a hemispherical solid angle about the thruster beam axis, this design approach can easily impose inefficient or unacceptable constraints on spacecraft design.

The only devices used with ion thrusters to provide some divergent beam shielding have been simple conical beam shields that diverge in the downstream direction of the ion beam. This type of device suffers at least one serious disadvantage, viz, that the device does not provide for reduction or control of the sputter products and degraded beam ions produced upon ion beam impingement of the shield.

Other devices of possible interest include those disclosed in U.S. Pat. No. 3,130,542 (Kuhrts) and U.S. Pat. No. 3,535,880 (Work et al.). The Kuhrts patent discloses a collector system for neutral particles wherein a conical collector which surrounds the discharge beam of an ion engine collects and recirculates un-ionized particles. The Work et al. patent discloses an ion beam deflection system which is primarily used for deflection steering.

SUMMARY OF THE INVENTION

The present invention provides for an ion thruster beam shield that essentially totally eliminates primary beam ions and thruster-produced neutral species, including associated sputter products, from emanating from the thruster outside of a precisely defined conical bean angle. The shield also prevents the efflux in any direction of more than a minimal flux of sputter products from the beam shield itself.

In accordance with a preferred embodiment of the invention, a beam shield for physically defining the angular divergence of the beam of an ion thruster engine comprises a housing and a plurality of vanes attached to the interior wall of the housing and extends inwardly therefrom. The housing is adapted to be fixedly attached at one end thereof to the ion thruster engine symmetrical with the longitudinal axis of the beam, and it extends downstream from the ion thruster engine so as to surround the ion beam. The vanes cooperate with the interior housing wall to control the divergence of the ion beam produced by the ion thruster engine. The vanes are spaced along the length of the housing wall and are angled so as to provide optimum beam definition.

Among the other advantages of the invention is that the shield possesses excellent mechanical strength and rigidity, since in addition to their other functions, the vanes act as stiffeners for the housing. Thus minimal material thicknesses are needed to meet applicable strength and rigidity requirements.

According to a further feature of the invention, the inner edges of the vanes are beveled so as to reduce undesired sputtering of material from the vanes into the beam cone.

In accordance with a further important feature, the vanes and housing are designed to direct the material sputtered from the beam shield by the ion beam in an upstream direction. Hence the beam shield may be so designed as to cause controlled deposition of sputtered beam shield material on the accelerator grid to replace material which has eroded therefrom. Alternatively, the beam shield may be so configured as to minimize such deposition on the accelerator grid.

Additional features and advantages of the invention will be set forth in, or apparent from, the detailed description of the preferred embodiments of the invention found hereinbelow.

DETAILED DESCRIPTION OF THE PREFERRED EMBODIMENTS

Figure 1:
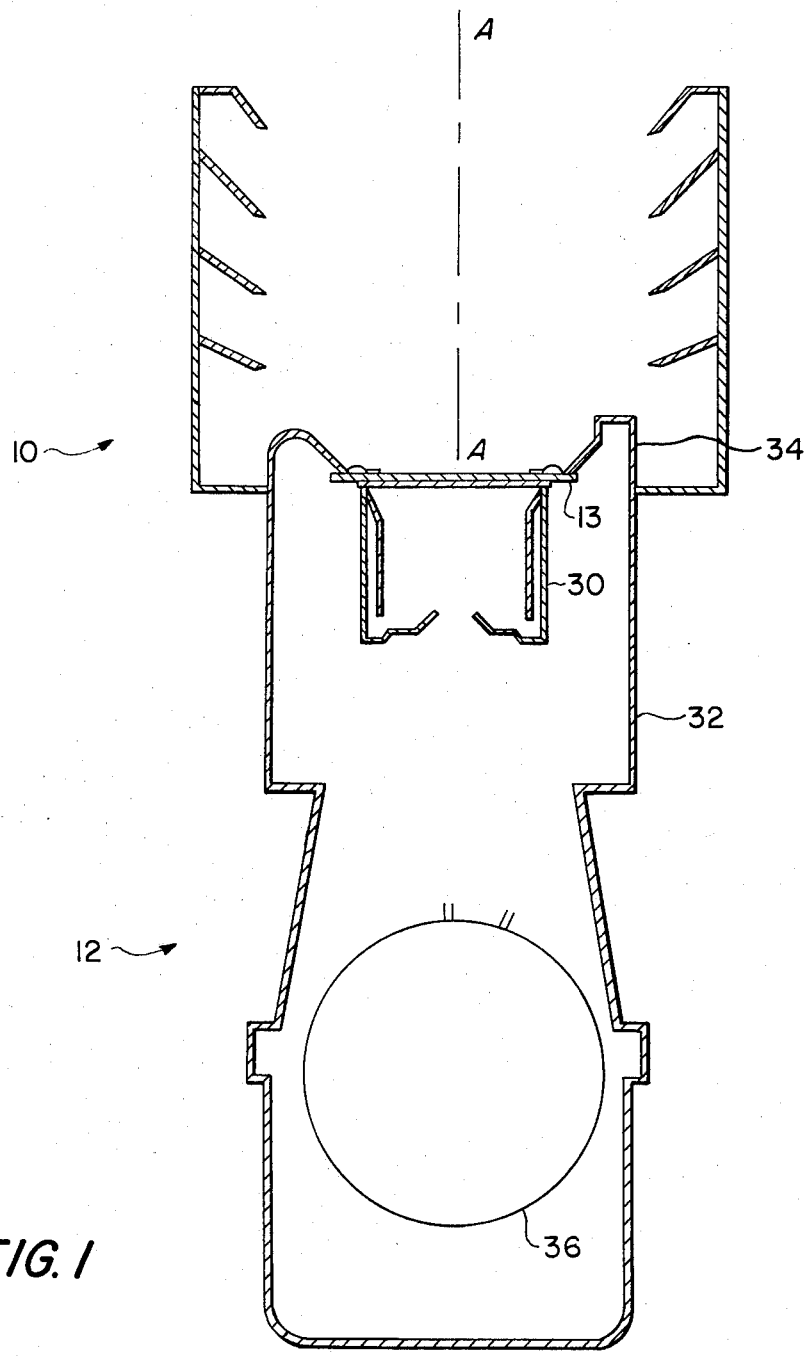
FIG. 1 is a longitudinal cross sectional view of an ion thruster incorporating a beam shield constructed in accordance with a preferred embodiment of the invention.
Figure 2:
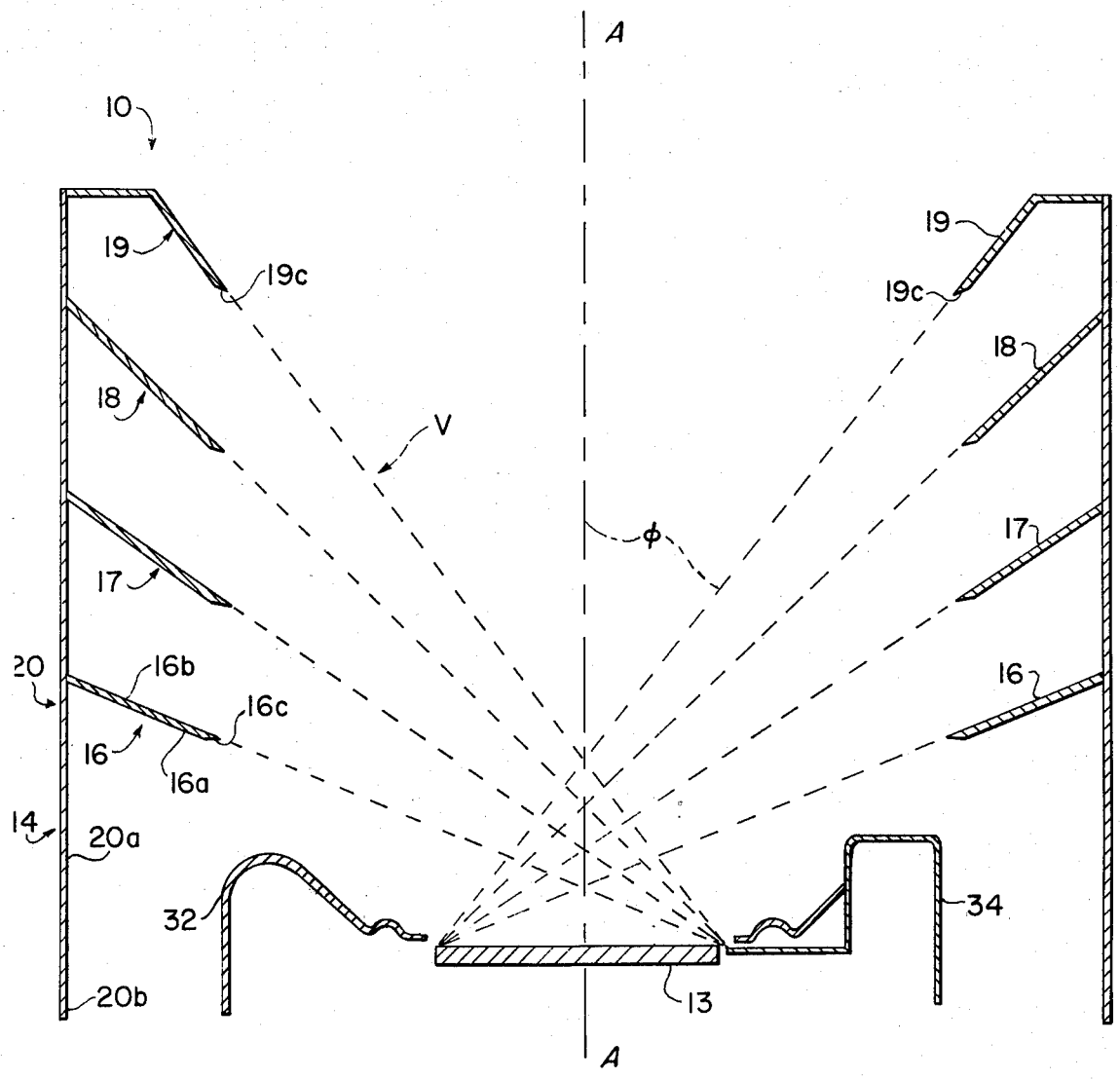
FIG. 2 is a transverse cross sectional view of the beam shield of FIG. 1, drawn to an enlarged scale.

Referring to FIGS. 1 and 2, a presently preferred embodiment of the present invention is shown. As illustrated in FIG. 1 the beam shield, which is denoted 10, is mounted on an ion thruster 12 having a grid system 13. For purposes of description, the ion thruster beam shield 10 can be broken into the following functional units: a housing 14 and a plurality of vanes, collectively designated V and individually designated 16, 17, 18 and 19.

The housing 14 comprises an elongate cylinder or cylindrical tube 20 which includes an interior surface 20*a* and a mounting end 20*b* which is attached to ion thruster 12. The beam shield has an axis of symmetry denoted A—A.

Vanes 16 to 19 are generally annular in shape and, as illustrated, each is secured at one circumferential edge thereof to inner surface 20*a* of housing 14, except vane 19 which is secured to a planar annular lip or rim which extends inwardly from the downstream edge of cylinder 20 in a plane perpendicular to the axis of symmetry A—A. Vanes 16 to 19 are each symmetrical about axis A—A and longitudinally spaced along the inner surface 20*a* of housing 14. As illustrated, vanes 16 to 19 each extend inwardly and upstream so as to form an acute angle with a horizontal plane through the line of intersection with housing 14. The number of degrees in the acute angle so formed is different for each of the vanes 16 to 19 and, as shown, increases with the distance from the attachment end 20*b* of housing 14 so that the acute angle defined by vane 19 is greater than that defined by vane 18 and so on, with the smallest angle defined by vane 16. Moreover, as shown in dashed lines in FIG. 2, vanes are such that a straight line extension of each vane as viewed in cross section intersects the downstream plane of the grid system at the opposite edge of the area from which the ion beam emanates.

Considering vane 16 as exemplary, this vane includes an upstream side 16*a* and a downstream side 16*b*. Further, the free end thereof is beveled to define a circumferential knife edge 16*c*. The function of knife edge 16*c* will be explained hereinbelow in discussing the operation of the beam shield of the invention.

The ion thruster 12 to which beam shield 10 is affixed is of conventional construction. In addition to grids 13, ion thruster 12 also includes (see FIG. 1) a discharge chamber 30, a ground screen 32, a hollow cathode neutralizer 34 and a reservoir 36, which in the case of a mercury ion thruster such as is under consideration here, contains mercury. Given the conventional nature of the ion thruster shown in FIG. 1, further discussing thereof is thought to be unnecessary.

Figure 3:
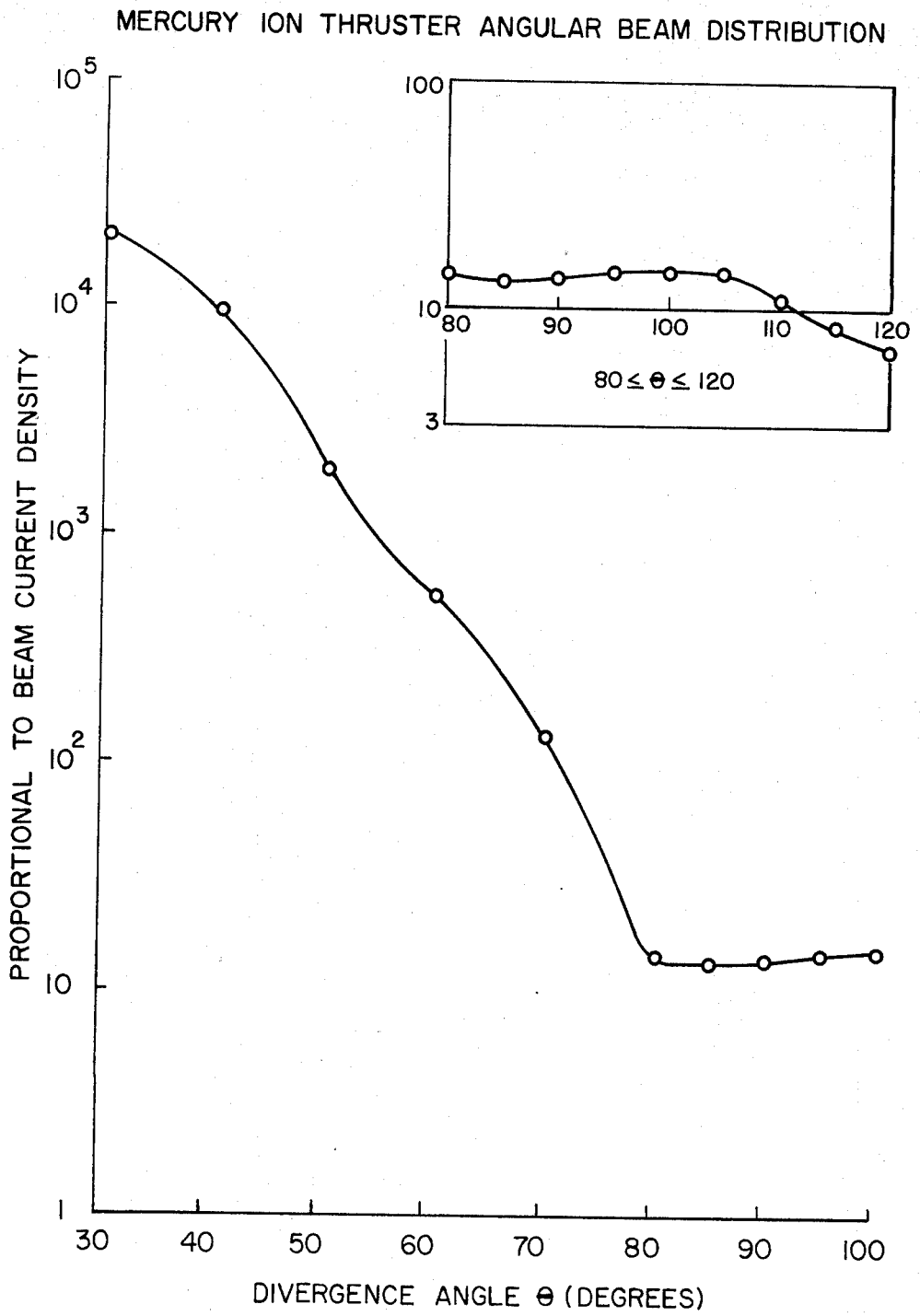
FIG. 3 is a graph of the angular beam current density distribution of a mercury ion thruster without a beam shield.

FIG. 3 depicts a graph taken from: TRW Systems Group: "Solar Electric Propulsion/Instrument Subsystems Interaction Study," Mid-Term Briefing, Sept. 19, 1972; P. 119, illustrating the angular beam distribution of a coventional mercury ion thruster without any type of beam shield attached thereto. The graph demonstrates that a forward hemisphere about the thruster axis is subjected to a flux of ions emanating from the thruster thereby creating the problems discussed above.

Turning now to a consideration of the operation of the beam shield shown in FIGS. 1 and 2, the beam shield vanes 16 to 19 are so oriented that the divergent beam intercepted by the shield 10 strikes the upstream side of each vane (side 16*a* of vane 16), as well as the inside cylindrical surface 20*a* of the shield housing 14. The divergent beam ions intercepted by the shield 10 have energies as high as 1400 eV, depending on the net thruster accelerating potential, and hence cause substantial sputtering of the shield surfaces that they strike. The angular distribution of this sputtered material from each sputtered surface is expected to be peaked at an emission angle somewhat forward of the normal to the surface. Hence, far the largest proportion of shield material sputtered from the underside of each of the vanes 16 to 19 should land on and adhere to the adjacent inside cylindrical surface 20*a* of the shield housing 14 and the downstream side of the facing vane, which, for vane 17, would be side 16*b* of facing vane 16. Similarly, most of the shield material sputtered from the inside cylindrical surface 20*a* of the shield housing 14 should land on and adhere to the underside of the next vane downstream. The shield thus minimizes the flux of sputtered shield material directed back toward the thruster grid system 13.

The shapes and positioning of beam shield vanes 16 to 19 are such that none of the shield surfaces exposed to the thruster beam, except for the knife edges of free ends of the vanes (edge 16*c* of vane 16), can emit sputtered material that is capable of exiting from the beam-shield 10 on a straight line trajectory, either into the shield-defined beam cone or outside of this cone. All beam sputtered material from the shield 10, except for that from the vane edges, must strike either another shield surface or the exposed portion of the thruster within the shield 10. Similarly, beam ions which strike shield 10 and are scattered therefrom without losing all their energy cannot exit from the shield 10 on any straight line trajectory. Such ions could exit after sticking to the second surface they hit, there being neutralized, and then evaporating off again, or they could also exit after a second scattering collision with the shield 10 in which they again would not lose all their energy. However, in both instances there is produced only a relatively small flux of mercury ions and neutral molecules emerging from the beam shield 10 outside the beam angle defined by vane 19. As implied above, the inner or free edges of the beam shield vanes 16 to 19 do act as sources of sputtered shield material which can directly exit from the shield both within and outside the shield-defined beam cone. However, this exiting sputter flux can be reduced to whatever low level is required by beveling each vane to a sufficiently sharp knife edge corresponding to knife edge 16*c* of vane 16, since only the rounded, innermost extremity of the edge produces the objectionably directed sputter flux.

The operation of beam shield 10 can be improved by the selection of a proper material therefor. For example, it is expected that the innermost edge 19*c* of the most downstream vane 19 will receive the highest beam current density of any point of beam shield 10. Thus, from available sputter yield data for mercury ions, an estimate can be made of the thickness of material required for innermost edge 19c of beam shield vane 19 in order to survive a representative space mission. For example, such a mission typically requires 5000 hours of thruster operation at an ion beam current of 23.4 mA. Table I lists nine attractive construction materials for the beam shield and gives for each of these the estimated sputter yield for 1400 eV $Hg^+$ ions, the density, and the calculated erosion depth after 5000 hours of thruster operation. It will be seen that only moderate thicknesses of the metallic materials and much reduced thicknesses of the carbonaceous materials are required to survive the worst sputter erosion conditions anticipated for the beam shield.

TABLE I

CONSTRUCTION MATERIALS AND SPUTTER DATA FOR BEAM SHIELD

| Construction material | Density, g/cc | Sputter yield for 1400 eV $Hg^+$ ions[1], atoms/ion | Approximate erosion depth[2], mils |
|---|---|---|---|
| Molybdenum | 10.2 | 1.5[3] | 53 |
| Tungsten | 19.4 | 0.8[3] | 29 |
| Tantalum | 16.6 | 1.5 | 60 |
| Magnesium | 1.7 | 1.4[4] | 76 |
| Aluminum | 2.7 | 1.4 | 54 |
| Titanium | 4.5 | 1.0 | 38 |
| Iron (steel) | 7.9 | 1.7 | 44 |
| Carbon (graphite) | 2.2 | 0.4 | 8 |
| C,H,O,F,N (plastics) | 1.2–2.2 | 0.4[5] | 11[5] |

Notes:

[1]Sputter yields are for normal indicence and, except as otherwise noted, have been estimated by taking 2.5 times the sputter yields for 500 eV $Hg^+$ions given in Carter, G., and Colligan, J. S.: Ion Bombardment of Solids (American Elsevier Pub. Co., New York, 1968), p. 323.

[2]Calculated assuming normal incidence of the ions, since the sputter yield and geometric corrections for oblique incidence approximately cancel each other, according to Kemp, R. F., and Hall, D. F.: "Final Report: Ion Beam Diagnostics and Neutralization," TRW, NASA CR-72343, Sept. 1967, p. 95.

[3]Values from curves of note 2 reference, p. 89.

[4]Estimated as equal to value for aluminum

[5]Sputter yield estimated and erosion depth calculated for polytetrafluoroethylene.

An important consideration in the choice of construction material for the beam shield 10 is the effect of the back-sputtered shield material on the thruster performance during extended continuous and cycled operation. At points on thruster grid system 13 where this back-sputtered material accumulates faster than it is sputtered off again by ions from the beam, this material may build up sufficiently in thickness to peel off in flakes. This is especially likely to result from thermal cycling of the grids 13 during cycled thruster operation, due to a thermal expansion and contraction mismatch between the sputter-deposited layer and the grid substrate material. Such grid flakes have been found to be very deleterious to long term thruster operation as they can cause persistent short circuits between the closely spaced accelerator and screen grids forming the grid system 13 which operates at a potential difference up to 2100 V, and bad localized beam defocusing which results in heavy, localized grid erosion.

At least two solutions are available to the potential problem of back-sputtered shield material building up on the thruster grids. One is to fabricate the shield of a suitable material having a thermal expansion coefficient close to that of the material of the grid, which, in the exemplary embodiment under consideration, is molybdenum. Of the materials listed in Table I, only molybdenum, tungsten, and perhaps tantalum meet this restriction. Another solution to the problem is to construct the shield of a material which will evaporate off the grids in the normal grid operating temperature range of 250° – 350°C. Of the materials listed in Table I, only magnesium or any of several magnesium alloys have a sufficiently high vapor pressure ($\sim 2.5\times10^{-5}$ torr at 300°C) to be a feasible construction material for use in adopting this approach. Another approach is to use grit blasting of the grids combined with the aforementioned solutions.

It is, of course, not necessary to fabricate the entire beam shield of whatever material is most favorable from a consideration of sputter yields and the characteristics of sputter deposits of the material. Instead the shield may be fabricated of any suitable structural material and the internal surfaces subjected to ion beam impingement then plated, coated, or otherwise covered with the chosen material to the required thickness.

The basic design of the beam shield 10, as shown in FIGS. 1 and 2, may be scaled and modified so as to perform the same beam shielding function for a variety of ion thrusters. The design may also be modified to produce conical beams with any desired maximum divergence angle $\phi$ (FIG. 2) greater than about 30°. Below this approximate lower limit, the problems associated with back-sputtered shield material, erosion of shield surfaces, and thrust loss are presently thought to be prohibitive. In designing a beam shield to define a fixed maximum divergence angle $\phi$, the available length and diameter for the shield are very important. The larger its inside diameter and the longer the beam shield is for a given defining angle, the less total beam current it will intercept, the less back-sputtered flux directed at the thruster grids it will produce, and the less rapidly its most heavily eroded surface will be eroded. However, as the shield length is increased, its diameter must also be increased (or else the number of vanes 16 to 19 required to prevent the efflux of sputtered shield material must be substantially increased), its volume and weight will consequently be substantially increased, and its strength and rigidity will become much more critical.

It should be noted that the basic invention, which has been discussed above in relation to a beam shield for a mercury ion thruster 12, is applicable to other types of ion thrusters that are not of the electron bombardment type such as contact ionization and colloid thrusters.

Further, in accordance with an alternative embodiment, the beam shield may be purposely designed to provide, during thruster operation, a continuous, uniform flux of back-sputtered material which coats the thruster grid surfaces at a controlled rate approximately matching and compensating for the beam-caused erosion of these surfaces. With molybdenum grids this would require that the whole shield 10, or at least the interior surfaces, and vanes 16 thru 19 subject to the most intense beam impingement, be fabricated of molybdenum also, in order that the back-sputtered shield material best match and adhere to the grid substrate material. If localized beam erosion of the grids is relatively minor, it is possible that the net erosion rate of the grids can be reduced nearly to zero by means of this embodiment of the invention.

It is also pointed out that with suitable redesign and the use of suitable materials in its construction, beam shield described above can possibly be made to serve both as a beam shield and as the beam neutralizer, so that the hollow cathode neutralizer 34 presently incorporated in all mercury ion thrusters could be eliminated. The possibility of using the beam shield as the neutralizer arises from the strong interaction of the thruster beam, and hence the beam plasma, with the shield. Elimination of the hollow cathode neutralizer in mercury ion thrusters offers many substantial benefits, including the elimination of the erosion, startup, and extinction problems associated with this type of neutralizer; elimination of a mercury feed subsystem (not shown) with its associated isolator, vaporizer, and cathode; and elimination of three power supplies and an ignitor with their associated logic and control circuitry.

Although the present invention has been described relative to an exemplary embodiment thereof, it will be understood by those skilled in the art that variations and modifications can be effected in these embodiments without departing from the scope and spirit of the invention.

I claim:

1. A beam shield for controlling the beam of a ion thruster engine, said shield comprising: a housing which is adapted to be fixedly attached at one end thereof to the ion thruster engine and which, in use, extends from the ion thruster engine and surrounds the ion beam, and a plurality of vanes, attached to the interior wall of said housing and extending therefrom, for cooperating with said interior housing wall to control the exit width of the ion beam produced by the ion thruster engine.

2. A beam shield in accordance with claim 1 wherein said housing is an elongate cylinder, and wherein said vanes are of generally annular shape, one circumferential edge of each vane being attached to said interior wall of said cylinder, said vanes being longitudinally spaced along the length of said housing, each of said vanes extending inwardly from said interior surface toward the end of said housing that is attached to the ion thruster engine, so as to form an acute angle with a plane perpendicular to the axis of symmetry of the housing and passing through the line of attachment of the vane to the housing.

3. A beam shield in accordance with claim 2 wherein the number of degrees in the acute angle formed by each of the vanes is different and increases in sequence beginning at the vane closest to the attachment end of said housing.

4. A beam shield in accordance with claim 3 wherein the free ends of said vanes are beveled to reduce undesired sputtering of the beam shield material.

5. A beam shield in accordance with claim 1 wherein at least the interior surface of said housing and at least the surface of said plurality of vanes comprise a metallic alloy selected from the group consisting of magnesium, molybdenum, tungsten, tantalum, and titanium alloys.

6. A beam shield in accordance with claim 1 wherein at least the interior surface of said housing and at least the surface of said plurality of vanes comprises graphite.

7. In combination, an ion thruster including a thruster grid, and a beam shield mounted on said ion thruster for controlling the beam produced by said thruster grid, said beam shield being symmetrical with the longitudinal axis of the beam and comprising a housing which surrounds said beam and a plurality of vanes which extend inwardly from the interior wall of said housing and which cooperate with said housing to limit the divergence of the beam to a predetermined angle.

8. The combination claimed in claim 7 wherein said housing comprises a cylindrical housing and said vanes are spaced along the length of said cylindrical housing, said vanes being generally annular in shape and extending inwardly from the interior wall of the housing such that a straight line extension of each vane, in cross section, will intersect the opposite edge of the accelerator grid active area.

9. The combination claimed in claim 7 wherein the free ends of said vanes are beveled to form a knife edge.

10. The combination claimed in claim 7 wherein the shield surfaces which receive the greatest beam impingement are fabricated of a material which provides enhanced election emission.

11. The combination as claimed in claim 7 wherein said grid is fabricated of molybdenum and at least the interior surfaces of said beam shield subject to the most intense beam impingement are fabricated of molybdenum.

12. The combination claimed in claim 7 wherein said vanes and said housing direct sputtered flux from beam impingement away from the grid.

13. The combination claimed in claim 7 wherein said vanes and said housing direct sputtered flux from beam impingement toward the grid.

* * * * *